US011680225B2

(12) United States Patent
Meier et al.

(10) Patent No.: US 11,680,225 B2
(45) Date of Patent: Jun. 20, 2023

(54) METHOD FOR PRODUCING A WASHING AGENT WITH IMPROVED OPTICAL AND RHEOLOGICAL PROPERTIES

(71) Applicant: Henkel AG & Co. KGaA, Duesseldorf (DE)

(72) Inventors: Frank Meier, Duesseldorf (DE); Peter Schmiedel, Duesseldorf (DE); Daniel Thomas Piorkowski, Fairfield, CT (US); Thorsten Ott, Moenchengladbach (DE); Piotr Tkacz, Duesseldorf (DE); Stefan Hammelstein, Duesseldorf (DE); Volker Blank, Leverkusen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/937,103

(22) Filed: Jul. 23, 2020

(65) Prior Publication Data

US 2022/0025293 A1 Jan. 27, 2022

(51) Int. Cl.

| | |
|---|---|
| ***C11D 11/00*** | (2006.01) |
| ***C11D 17/04*** | (2006.01) |
| ***C11D 1/83*** | (2006.01) |
| ***C11D 1/04*** | (2006.01) |
| ***C11D 3/04*** | (2006.01) |
| ***C11D 1/22*** | (2006.01) |
| ***C11D 1/29*** | (2006.01) |
| ***C11D 3/20*** | (2006.01) |

(52) U.S. Cl.

CPC ..... *C11D 1/22* (2013.01); *C11D 1/29* (2013.01); *C11D 1/8305* (2013.01); *C11D 3/046* (2013.01); *C11D 3/2013* (2013.01); *C11D 3/2079* (2013.01); *C11D 11/0017* (2013.01); *C11D 17/043* (2013.01)

(58) Field of Classification Search

None

See application file for complete search history.

(56) References Cited

U.S. PATENT DOCUMENTS

| | | | | |
|---|---|---|---|---|
| 3,658,552 | A | 4/1972 | Carlson et al. | |
| 6,855,680 | B2 | 2/2005 | Smerznak et al. | |
| 8,901,062 | B2 | 12/2014 | De Meirleir et al. | |
| 9,023,786 | B2 | 5/2015 | Schmiedel et al. | |
| 9,187,714 | B2 | 11/2015 | Schmiedel et al. | |
| 2003/0013630 | A1* | 1/2003 | Ishikawa | C11D 3/128 510/475 |
| 2015/0074921 | A1* | 3/2015 | Miracle | C09B 69/00 8/137 |
| 2015/0376550 | A1* | 12/2015 | Ohtani | C11D 17/042 510/296 |
| 2016/0102278 | A1* | 4/2016 | Labeque | C11D 17/045 510/296 |
| 2017/0015948 | A1* | 1/2017 | Johnson | C11D 3/30 |
| 2018/0037858 | A1* | 2/2018 | Keuleers | B65D 65/46 |
| 2018/0112157 | A1* | 4/2018 | Bellomi | C11D 11/04 |
| 2021/0155883 | A1* | 5/2021 | Piorkowski | C11D 1/831 |

FOREIGN PATENT DOCUMENTS

| | | | |
|---|---|---|---|
| EP | 0922754 | A1 | 6/1999 |
| EP | 3124585 | A1 | 2/2017 |
| EP | 3202879 | A1 | 8/2017 |
| EP | 3517596 | A1 | 7/2019 |
| WO | 2010141301 | A1 | 12/2010 |
| WO | 2015148763 | A1 | 10/2015 |
| WO | 2016176280 | A1 | 11/2016 |

OTHER PUBLICATIONS

"Microplastic-Free, Opacified Liquid Laundry Detergents" U.S. Appl. No. 62/938,707 Piorkowski, Daniel Thomas et al., filed Nov. 21, 2019.

* cited by examiner

*Primary Examiner* — Lorna M Douyon

(74) *Attorney, Agent, or Firm* — Bojuan Deng

(57) ABSTRACT

A method for producing a liquid, surfactant-containing washing agent containing: i) 20 to 80 wt. % surfactant; ii) 2 to 15 wt. % fatty acid; iii) 0.3 to 8 wt. % of salt of a divalent cation; iv) 8 to 35 wt. % solvent; the method including the steps of: a) providing a first flowable washing agent preparation containing a surfactant, fatty acid and solvent; b) introducing the salt of a divalent cation into the liquid composition so as to form a salt-containing composition; c) mixing the salt-containing composition.

20 Claims, No Drawings

METHOD FOR PRODUCING A WASHING AGENT WITH IMPROVED OPTICAL AND RHEOLOGICAL PROPERTIES

FIELD OF THE INVENTION

The present invention relates to a method for producing a liquid, surfactant-containing washing agent. The invention relates in particular to a sequential method for producing a liquid, surfactant-containing washing agent with improved optical and rheological properties.

BACKGROUND OF THE INVENTION

Continuously changing requirements are placed on the forms in which washing and cleaning agents are packaged and sold. For some time, the consumer has paid special attention to the easy dosing of washing and cleaning agents and the simplification of the operational steps required to carry out a washing or cleaning process. A solution is provided by pre-portioned washing or cleaning agents, for example film pouches having one or more receiving chambers for solid or liquid washing or cleaning agents, with particular attention from a technical point of view being paid to the development and production of liquid washing agents that are suitable for packaging in water-soluble film pouches.

The commercial success of a washing agent portion unit is of course also determined, in addition to processing-related aspects, by the ability to provide a product that meets consumer interests. An essential means of communicating product quality and product claims is the appearance of the product, including the shape and color of the portion unit. This applies in particular to water-soluble film pouches, the soluble films of which are generally transparent and give a clear view of the solid or liquid washing agents contained. While colored, i.e. non-white, liquid washing agents can be obtained in a simple manner by adding appropriate dyes, the provision of white liquid washing agents is more challenging because the opacifying agents previously used for their production are increasingly being critically assessed from an ecological point of view. Against this background, the provision of an ecologically acceptable opacifying agent is a relevant development objective in the field of liquid washing and cleaning agents.

Liquid washing agents are generally produced by means of a sequential method, during which the ingredients of the washing agent are mixed with one another in a temporal sequence. To achieve a homogeneous end product, the respective intermediate products and the end product are mixed, with input of energy. The end product is not only distinguished by the most homogeneous distribution of active ingredients possible, but also by rheological properties suitable for handling by the consumer. The type and time of adjustment of these rheological properties during the production method influences the efficiency of the method as well as the final product quality, since the rheological properties of the intermediate and end products are closely related to the amount of energy to be input for homogenization during production and the mechanical load on the intermediate and end products and the components thereof.

BRIEF SUMMARY OF THE INVENTION

In summary, the object of the application was to provide an efficient method for producing visually appealing, concentrated liquid washing agents. The resulting washing agents are intended to also be particularly suitable for packaging in water-soluble film pouches.

The present invention relates first to a method for producing a liquid, surfactant-containing washing agent containing i) 40 to 80 wt. % surfactant;
ii) 2 to 15 wt. % fatty acid;
iii) 0.3 to 8 wt. % of salt of a divalent cation;
iv) 8 to 35 wt. % solvent;

said method comprising the steps of:

a) providing a first flowable washing agent preparation containing a surfactant, fatty acid and solvent;
b) introducing the salt of a divalent cation into the washing agent preparation so as to form a salt-containing washing agent preparation;
c) mixing the salt-containing washing agent preparation.

The starting point of the method according to the invention is the provision of a first flowable washing agent preparation containing a surfactant, fatty acid and solvent in step a). This preparation can be produced in advance in a continuous or discontinuous manner. A line system, preferably provided with mixing devices, is suitable for continuous production, in which system the components of the preparation are brought into contact with one another and mixed. Due to the reduced amount of equipment required and the reduced operational complexity, however, it is preferable for the first flowable washing agent preparation to be provided discontinuously. Suitable for this purpose is the provision of the preparation as a storable mixture (master batch) in a stirred tank reactor or another type of container. A container of this type not only makes it possible to store intermediate products, but also allows any fluctuations in the throughput rates of the subsequent, preferably continuous method steps b) and c) to be alleviated. It is therefore also preferable for the first flowable washing agent preparation to be continuously introduced from a buffer container into a main line.

In step b) of the method, the salt of a divalent cation is introduced into the liquid composition. This is preferably achieved via a secondary line, through which the salt is continuously introduced into the main line. To simplify the procedure, it is preferable for the salt of a divalent cation to be introduced into the main line, via a secondary line, in the form of an aqueous solution.

The addition of the salt of a divalent cation leads to the formation of a cloudy-white appearance and a sufficiently high and stable viscosity, which is advantageous in terms of the rest of the procedure and the subsequent use. The formation of these two physical properties of the liquid composition is promoted by mixing all of the ingredients together. It is therefore also preferable for the outlet opening of the secondary line, through which the salt of a divalent cation is introduced into the main line via a secondary line, to be provided within the operating range of a mixing device which is attached within the main line. The mixing device can be a static or dynamic mixer. A static mixer which is connected downstream of the outlet opening of the secondary line in the flow direction is preferably used.

When the salt of the divalent cation is added, the flowable washing agent preparation preferably has a temperature of between 20 and 40° C. Both while the salt is being introduced and during the later method steps, there is generally neither heating nor cooling of the The resulting metal-salt-containing composition can subsequently be developed or differentiated by adding further active substances. Particularly suitable for this purpose is the addition of an active substance from the group of optionally encapsulated fragrances, enzymes, preservatives and bitterns, preferably from the group of optionally encapsulated fragrances, enzymes and preservatives, which substance is preferably introduced into the main line, via a secondary line, after step b). It is particularly preferable for an active substance from the group of fragrances or enzymes to be introduced into the main line, via a secondary line, after step b). It is therefore also preferable for the outlet opening of the secondary line, through which the active substance is introduced into the main line via a secondary line, to be provided within the operating range of a mixing device which is attached within the main line. The mixing device can be a static or dynamic mixer. A static mixer which is connected downstream of the outlet opening of the secondary line in the flow direction is preferably used.

The further active substance can be added to the composition before the mixing step c) or after this step.

In summary, a first method variant comprises the steps of:

a1) providing a first flowable washing agent preparation containing a surfactant, fatty acid and solvent;

a2) continuously introducing the first flowable washing agent preparation into a main line;

b1) continuously introducing the salt of a divalent cation into the washing agent preparation into the main line, via a secondary line, so as to form a salt-containing washing agent preparation;

b2) continuously introducing an active substance from the group of fragrances or enzymes into the main line, via a secondary line, so as to form a salt-containing and active substance-containing washing agent preparation;

c) mixing the salt-containing and active substance-containing washing agent preparation, it being preferable to connect a static mixer in the main line downstream of the outlet openings of the secondary line in the flow direction of the washing agent preparation in step b1) and/or step b2).

In a second preferred variant, the further active substance is introduced after method step c). Such a procedure is advantageously supplemented by a further mixing step, which follows the introduction of the active substance. The use of static mixers is particularly suitable for this mixing step.

In summary, a second method variant comprises the steps of:

a1) providing a first flowable washing agent preparation containing a surfactant, fatty acid and solvent;

a2) continuously introducing the first flowable washing agent preparation into a main line;

b) continuously introducing the salt of a divalent cation into the washing agent preparation into the main line, via a secondary line, so as to form a salt-containing washing agent preparation;

c) mixing the salt-containing composition;

d) continuously introducing an active substance from the group of fragrances or enzymes into the salt-containing washing agent preparation located in the main line via a secondary line;

e) mixing the salt-containing and active substance-containing washing agent preparation, it being preferable to connect a static mixer in the main line downstream of the outlet openings of the secondary line in the flow direction of the washing agent preparation in step b) and/or step d).

DETAILED DESCRIPTION OF THE INVENTION

A first essential component of the liquid, surfactant-containing washing agent and the first flowable washing agent preparation is the surfactant, which is contained in the liquid, surfactant-containing washing agent in an amount of 20 to 80 wt. %, preferably 30 to 75 wt. % and in particular 40 to 70 wt. %.

The group of surfactants include the non-ionic, anionic, cationic and amphoteric surfactants. The group of surfactants also includes the co-surfactants described below. The compositions according to the invention can comprise one or more of the surfactants mentioned. Particularly preferred compositions contain at least one anionic surfactant as the surfactant.

The anionic surfactant is preferably selected from the group comprising $C_9$-$C_{13}$ alkylbenzene sulfonates, olefin sulfonates, $C_{12}$-$C_{18}$ alkane sulfonates, ester sulfonates, alk(en)yl sulfates, fatty alcohol ether sulfates and mixtures thereof. Compositions which comprise $C_9$-$C_{13}$ alkylbenzene sulfonates and fatty alcohol ether sulfates as the anionic surfactant have particularly good dispersing properties. Surfactants of the sulfonate type that can be used are preferably $C_9$-$C_{13}$ alkylbenzene sulfonates, olefin sulfonates, i.e. mixtures of alkene and hydroxyalkane sulfonates, and disulfonates, as obtained, for example, from $C_{12}$-$C_{18}$ monoolefins having a terminal or internal double bond by way of sulfonation with gaseous sulfur trioxide and subsequent alkaline or acid hydrolysis of the sulfonation products. $C_{12}$-$C_{18}$ alkane sulfonates and the esters of α-sulfofatty acids (ester sulfonates) are also suitable, for example the α-sulfonated methyl esters of hydrogenated coconut, palm kernel or tallow fatty acids.

The alkali salts and in particular the sodium salts of the sulfuric acid half-esters of $C_{12}$-$C_{18}$ fatty alcohols, for example from coconut fatty alcohol, tallow fatty alcohol, lauryl alcohol, myristyl alcohol, cetyl alcohol or stearyl alcohol, or of $C_{10}$-$C_{20}$ oxo alcohols and the half-esters of secondary alcohols having these chain lengths are preferred as alk(en)yl sulfates. From a washing perspective, $C_{12}$-$C_{16}$ alkyl sulfates, $C_{12}$-$C_{15}$ alkyl sulfates and $C_{14}$-$C_{15}$ alkyl sulfates are preferred. 2,3-alkyl sulfates are also suitable anionic surfactants.

The salts of the sulfuric acid half-esters of fatty alcohols having 12 to 18 C atoms, for example from coconut fatty alcohol, tallow fatty alcohol, lauryl alcohol, myristyl alcohol, cetyl alcohol or stearyl alcohol, or of the oxo alcohols having 10 to 20 C atoms and the half-esters of secondary alcohols having these chain lengths are preferred as alk(en)yl sulfates. From a washing perspective, the alkyl sulfates having 12 to 16 C atoms, alkyl sulfates having 12 to 15 C atoms and alkyl sulfates having 14 and 15 C atoms are preferred. 2,3-alkyl sulfates are also suitable anionic surfactants.

Fatty alcohol ether sulfates, such as the sulfuric acid monoesters of straight-chain or branched $C_7$-$C_{21}$ alcohols ethoxylated with 1 to 6 mol ethylene oxide, such as 2-methyl-branched C9-11 alcohols having, on average, 3.5 mol ethylene oxide (EO) or C12-18 fatty alcohols having 1 to 4 EO, are also suitable. Alkyl ether sulfates of formula (A-1) are preferred $$R^1\text{—O-(AO)}_n\text{—SO}_3^-X^+ \quad \text{(A-1)}$$

In this formula (A-1), $R^1$ represents a linear or branched, substituted or unsubstituted alkyl functional group, preferably a linear, unsubstituted alkyl functional group, particularly preferably a fatty alcohol functional group. Preferred functional groups $R^1$ of formula (A-1) are selected from decyl, undecyl, dodecyl, tridecyl, tetradecyl, pentadecyl, hexadecyl, heptadecyl, octadecyl, nonadecyl, eicosyl functional groups and mixtures thereof, the representatives having an even number of C atoms being preferred. Particularly preferred functional groups $R^1$ of formula (A-1) are derived from fatty alcohols having 12 to 18 C atoms, for example from coconut fatty alcohol, tallow fatty alcohol, lauryl alcohol, myristyl alcohol, cetyl alcohol or stearyl alcohol, or from oxo alcohols having 10 to 20 C atoms.

In formula (A-1), AO represents an ethylene oxide (E0) or propylene oxide (PO) group, preferably an ethylene oxide group. The index n in formula (A-1) is an integer of from 1 to 50, preferably from 1 to 20, and in particular from 2 to 10. Very particularly preferably, n is 2, 3, 4, 5, 6, 7 or 8. X is a monovalent cation or the n-th part of an n-valent cation, the alkali metal ions, including $Na^+$ or $K^+$, being preferred in this case, with $Na^+$ being most preferred. Further cations $X^+$ may be selected from $NH4^+$, ½ $Zn^{2+}$, ½ $Mg^{2+}$, ½ $Ca^{2+}$, ½ $Mn^{2+}$, and mixtures thereof.

Particularly preferred compositions contain an alkyl ether sulfate selected from fatty alcohol ether sulfates of formula A-2

(A-2)

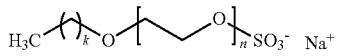

where k=11 to 19, and n=2, 3, 4, 5, 6, 7 or 8. Very particularly preferred representatives are Na fatty alcohol ether sulfates having 12 to 18 C atoms and 2 EO (k=11 to 13, n=2 in formula A-1). The degree of ethoxylation indicated represents a statistical average that can correspond to an integer or a fractional number for a specific product. The degrees of alkoxylation indicated represent statistical averages that can correspond to an integer or a fractional number for a specific product. Preferred alkoxylates/ethoxylates have a narrowed homolog distribution (narrow range ethoxylates, NRE).

In a particularly preferred embodiment, the composition contains $C_{9-13}$ alkylbenzene sulfonates and optionally also fatty alcohol ether sulfates as the anionic surfactant.

It is very particularly preferred for the composition to contain at least one anionic surfactant of formula (A-3)

(A-3)

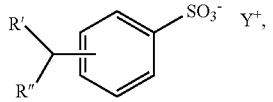

in which

R' and R" are, independently of one another, H or alkyl, and together contain 9 to 19, preferably 9 to 15 and in particular 9 to 13, C atoms, and $Y^+$ denotes a monovalent cation or the n-th part of an n-valent cation (in particular $Na^+$).

In summary, liquid, surfactant-containing washing agents preferably produced by means of the method according to the invention contain, as the surfactant, at least one anionic surfactant, preferably at least one anionic surfactant from the group consisting of $C_{8-18}$ alkylbenzene sulfonates, $C_{8-18}$ olefin sulfonates, $C_{12-18}$ alkane sulfonates, $C_{8-18}$ ester sulfonates, $C_{8-18}$ alkyl sulfates, $C_{8-18}$ alkenyl sulfates, fatty alcohol ether sulfates, in particular at least one anionic surfactant from the group of $C_{8-18}$ alkylbenzene sulfonates.

The proportion by weight of the anionic surfactant with respect to the total weight of the liquid, surfactant-containing washing agents is preferably 20 to 60 wt. % and in particular 22 to 50 wt. %.

As a second essential component, the liquid, surfactant-containing washing agent and the first flowable washing agent preparation contain fatty acid. For the optical properties, the viscosity profile and the cleaning performance of the preparation, it has proven advantageous for the liquid, surfactant-containing washing agent to contain, based on the total weight thereof, 4 to 12 wt. %, preferably 6 to 10 wt. %, fatty acid.

Preferred fatty acids are selected from the group of caprylic acid, capric acid, lauric acid, myristic acid, palmitic acid, stearic acid, oleic acid, linoleic acid and mixtures thereof.

As a third essential component, the liquid, surfactant-containing washing agent contains the salt of a divalent cation. The proportion by weight of this salt with respect to the total weight of the liquid, surfactant-containing washing agent is preferably 0.4 to 6 wt. % and in particular 0.5 to 4 wt. %. These proportions by weight have proven to be advantageous in terms of both the appearance and the viscosity of the preparation.

Because of their availability, magnesium or calcium salts are particularly preferably used, the divalent salt being particularly preferably selected from the group of the salts of divalent metal cations, in particular of magnesium and calcium salts, preferably from the group of magnesium chloride, magnesium sulfate, calcium chloride and calcium sulfate.

Preferred salts have a solubility in water (20° C.) above 400 g/l. The use of salts from the group of magnesium chloride and calcium chloride is very particularly preferred.

As a fourth essential component, the washing agent produced according to the invention contains a solvent. The proportion by weight of the solvent with respect to the total weight of the washing agent preparation is preferably 12 to 32 wt. % and in particular 15 to 30 wt. %. With regard to processability, in particular the dosing ability of the washing agent preparation in the method according to the invention, it has proven to be advantageous for the liquid, surfactant-containing washing agent to contain, based on the total weight thereof, 7 to 20 wt. %, preferably 10 to 18 wt. %, organic solvent.

Preferred organic solvents are selected from the group of ethanol, n-propanol, propanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether and mixtures thereof, preferably from the group of propanediol, glycerol and mixtures thereof.

The liquid, surfactant-containing washing agent is preferably a low-water mixture of substances. Washing agents of this kind which contain, based on the total weight thereof, less than 18 wt. %, preferably less than 15 wt. %, of water are preferred.

In summary, the method according to the invention is advantageous for liquid, surfactant-containing washing agents which contain, based on the total weight thereof, i) 20 to 80 wt. % surfactant including 20 to 50 wt. % anionic surfactant;
ii) 4 to 12 wt. % fatty acid;
iii) 0.5 to 4 wt. % of the salt of a divalent metal cation;
iv) 8 to 35 wt. % solvent.

The compositions of some preferably produced liquid, surfactant-containing washing agents can be found in the following tables (amounts given in wt. % are based on the total weight of the washing agent, unless otherwise indicated).

| | Formula 1 | Formula 2 | Formula 3 | Formula 4 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 6 | Formula 7 | Formula 8 | Formula 9 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 11 | Formula 12 | Formula 13 | Formula 14 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 16 | Formula 17 | Formula 18 | Formula 19 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 21 | Formula 22 | Formula 23 | Formula 24 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 26 | Formula 27 | Formula 28 | Formula 29 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 31 | Formula 32 | Formula 33 | Formula 34 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 36 | Formula 37 | Formula 38 | Formula 39 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

* preferably $C_{8-18}$ alkylbenzene sulfonates

In a technically advantageous variant of the method according to the invention, the liquid, surfactant-containing washing agent also contains, based on the total weight thereof, V) 0.5 to 4 wt. %, preferably 0.5 to 3 wt. % and in particular 0.5 to 2 wt. %, of the salt of a monovalent cation.

By adding the monovalent cation, the cloudy-white appearance of the washing agent preparation is enhanced. At the same time, the resulting compositions are distinguished by viscosity properties that are optimal for the procedure. In particular, the addition of the monovalent cation in large proportions by weight causes sufficient turbidity without increasing the viscosity of the washing agent preparation in a manner which makes it difficult to convey said preparation in pipe systems and dose said preparation in step c). Finally, the addition of the salt of a monovalent cation reduces the temperature dependence of the viscosity of the flowable washing agent preparation and thus simplifies the processing thereof.

The use of monovalent metal salts, in particular the use of sodium chloride, also improves the storage stability, in particular the storage stability in the event of temperature fluctuations.

Preferred monovalent cations are selected from the group of monovalent metal cations. Because of their availability and low costs, preferred salts of monovalent cations are selected from the group of sodium chloride, potassium chloride, sodium sulfate, sodium carbonate, potassium sulfate, potassium carbonate, sodium hydrogen carbonate, potassium hydrogen carbonate, very preferably from the group of sodium chloride.

In summary, a second particularly preferred embodiment of the method is characterized in that the liquid, surfactant-containing washing agent contains, based on the total weight thereof, i) 20 to 80 wt. % surfactant including 20 to 50 wt. % anionic surfactant;

ii) 4 to 12 wt. % fatty acid;

iii) 0.5 to 4 wt. % of the salt of a divalent metal cation;

iv) 8 to 35 wt. % solvent;

v) 0.5 to 4 wt. % of the salt of a monovalent metal cation.

The composition of some other particularly preferably produced liquid washing agents can be found in the following tables (amounts given in wt. % are based on the total weight of the washing agent, unless otherwise indicated).

| | Formula 1a | Formula 2a | Formula 3a | Formula 4a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 6a | Formula 7a | Formula 8a | Formula 9a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 11a | Formula 12a | Formula 13a | Formula 14a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 16a | Formula 17a | Formula 18a | Formula 19a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |

-continued

| | Formula 16a | Formula 17a | Formula 18a | Formula 19a |
|---|---|---|---|---|
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 21a | Formula 22a | Formula 23a | Formula 24a |
|---|---|---|---|---|
| Surfactant | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 26a | Formula 27a | Formula 28a | Formula 29a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 31a | Formula 32a | Formula 33a | Formula 34a |
|---|---|---|---|---|
| Surfactant | 20 to 60 | 20 to 60 | 20 to 50 | 20 to 50 |
| Fatty acid | 2 to 15 | 4 to 12 | 4 to 12 | 6 to 10 |
| Magnesium chloride,calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 36a | Formula 37a | Formula 38a | Formula 39a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride,calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 41a | Formula 42a | Formula 43a | Formula 44a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 46a | Formula 47a | Formula 48a | Formula 49a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 51a | Formula 52a | Formula 53a | Formula 54a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride,calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 56a | Formula 57a | Formula 58a | Formula 59a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride,calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

* preferably $C_{8-18}$ alkylbenzene sulfonates

In a further technically advantageous variant of the method according to the invention, the liquid, surfactant-containing washing agent contains, based on the total weight thereof, preferably 12 to 30 wt. %, more preferably 15 to 25 wt. %, non-ionic surfactant.

Preferred non-ionic surfactants are selected from the group of alkoxylated primary $C_{8-18}$ alcohols having a degree of alkoxylation of ≥4, particularly preferably the $C_{12-14}$ alcohols having 4 EO or 7 EO, the $C_{9-11}$ alcohols having 7 EO, the $C_{13-15}$ alcohols having 5 EO, 7 EO or 8 EO, the $C_{13-15}$ oxo alcohols having 7 EO, the $C_{12-18}$ alcohols having 5 EO or 7 EO, the $C_{13-15}$ oxo alcohols having 7 EO, in particular the primary $C_{12-18}$ alcohols having a degree of alkoxylation of ≥4, very particularly preferably the primary $C_{12-18}$ alcohols having 7 EO.

With regard to the rheological properties of the washing agent and the processability thereof, it has proven to be advantageous to use anionic surfactant and non-ionic surfactant in a weight ratio of from 3:1 to 1:2, preferably from 2:1 to 1:1.5 and in particular from 1.4:1 to 1:1.

It has proven to be technically advantageous to supplement the previously described surfactant system consisting of anionic and non-ionic surfactant with a further co-surfactant. The proportion by weight of the co-surfactant with respect to the total weight of the flowable washing agent preparation is preferably 0.3 to 5 wt. %. In the context of this application, the co-surfactants are not included in the surfactants described further above. Preferred co-surfactants are selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.

In summary, a third particularly preferred embodiment of the method is characterized in that the liquid, surfactant-containing washing agent contains, based on the total weight thereof, i) 32.3 to 80 wt. % surfactant including 20 to 50 wt. % anionic surfactant and 12 to 30 wt. % non-ionic surfactant;
ii) 4 to 12 wt. % fatty acid;
iii) 0.5 to 4 wt. % of the salt of a divalent cation;
iv) 8 to 35 wt. % solvent;
v) 0.3 to 5 wt. % of a co-surfactant that differs from the non-ionic surfactant and is selected from the group consisting of alkoxylated primary $C_8$-$C_{15}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_2$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.

The composition of some other particularly preferably produced liquid washing agents can be found in the following tables (amounts given in wt. % are based on the total weight of the washing agent, unless otherwise indicated).

| | Formula 1b | Formula 2b | Formula 3b | Formula 4b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |

-continued

| | Formula 1b | Formula 2b | Formula 3b | Formula 4b |
|---|---|---|---|---|
| Solvent | 8 to 35 | 12 to 32 | 12 to 32 | 15 to 30 |
| Misc. | to make up to 100 | to make up to 100 | to make up to 100 | to make up to 100 |

| | Formula 6b | Formula 7b | Formula 8b | Formula 9b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride,calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 11b | Formula 12b | Formula 13b | Formula 14b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 16b | Formula 17b | Formula 18b | Formula 19b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride,calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 21b | Formula 22b | Formula 23b | Formula 24b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |

-continued

| | Formula 21b | Formula 22b | Formula 23b | Formula 24b |
|---|---|---|---|---|
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 26b | Formula 27b | Formula 28b | Formula 29b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride,calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 31b | Formula 32b | Formula 33b | Formula 34b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 36b | Formula 37b | Formula 38b | Formula 39b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride,calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 41b | Formula 42b | Formula 43b | Formula 44b |
|---|---|---|---|---|
| Total surfactant | 32.3 to 80 | 32.3 to 75 | 35.5 to 75 | 40 to 70 |
| $C_{8-18}$ alkylbenzene sulfonate | 20 to 60 | 20 to 60 | 20 to 50 | 20 to 50 |
| Primary $C_{12-18}$ alcohols with 7 EO | 12 to 30 | 12 to 30 | 15 to 25 | 15 to 25 |
| $C_{13}$ alcohols with 2 EO or 3 EO | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride,calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

* preferably $C_{8-18}$ alkylbenzene sulfonates

** co-surfactant which differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3

*** primary $C_{12-18}$ alcohols having a degree of alkoxylation of ≥4, preferably primary $C_{12-18}$ alcohols having 7 EO

**** alkoxylated primary $C_{12}$-$C_{18}$ alcohols having a degree of alkoxylation of ≤3, preferably $C_{13}$ alcohols having 2 EO or 3 EO The liquid, surfactant-containing washing agent preferably has a viscosity (21° C., Brookfield viscometer type DV-II Pro, spindle no. 2, 20 rpm) above 400 mPas, preferably above 1000 mPas.

The liquid, surfactant-containing washing agent is preferably designed in the form of a structured system. The main types of structured systems used in practice are based on dispersed lamellar, spherulitic and attenuated lamellar phases. The liquid, surfactant-containing washing agent preferably contains a spherulitic phase. Spherulitic phases comprise spherical bodies, commonly referred to in the art as spherulites, in which surfactant double layers are arranged as concentric shells. The spherulites are dispersed in an aqueous phase in the manner of a classic emulsion, and interact to form a structured system. Preferred liquid washing agents comprise lamellar spherulites, preferably having a maximum diameter of from 10 to 100 μm, particularly preferably having a maximum diameter of from 25 to 50 μm.

The liquid, surfactant-containing washing agent preferably has a yield point (TA Instruments rotation rheometer AR 2000, 20° C., cone plate with 40 mm diameter, 2° cone angle) above 0.1 Pa, preferably above 0.3 Pa.

The rheological properties of the liquid washing agent justify its efficient processability in the method according to the invention and also form the basis of its advantageous optical properties, including its cloudy-white appearance.

The Nephelometric Turbidity Unit (NTU) is frequently used as an indication of transparency. It is a unit, used e.g. in water treatment, for measuring turbidity e.g. in liquids.

It is a unit of turbidity measured using a calibrated nephelometer. High NTU values are measured for clouded compositions, whereas low values are determined for clear compositions.

The HACH Turbidimeter 2100Q from Hach Company, Loveland, Colo. (USA) is used with the calibration substances StabICal Solution HACH (20 NTU), StabICal Solution HACH (100 NTU) and StabICal Solution HACH (800 N TU), all of which can also be produced by Hach Company. The measurement is filled with the composition to be analyzed in a 10 ml measuring cuvette having a cap and is carried out at 20° C.

At an NTU value (at 20° C.) of 60 or more, shaped bodies have a perceptible turbidity within the meaning of the invention, as can be seen with the naked eye. The turbidity (HACH Turbidimeter 2100Q, 20° C., 10 ml cuvette) of the liquid, surfactant-containing washing agent is preferably above 60 NTU, particularly preferably above 100 NTU and in particular above 400 NTU.

The liquid washing agent is preferably free from organic opacifying agents. "Free from," as used in this context, means that the corresponding component is present in the preparation in an amount of <1 wt. %, preferably <0.1 wt. %, more preferably <0.01 wt. %. In particular, a component of this kind is not deliberately added. The liquid, surfactant-containing washing agent preferably contains in particular no styrene-acrylate copolymers (INCI: styrene/acrylates copolymer).

The liquid, surfactant-containing washing agent produced according to the invention can be free from enzymes and/or fragrances. These components are in particular not contained because they can adversely affect the turbidity and thus the appearance of the formulation.

For example, liquid washing agents which contain, based on the total weight thereof, less than 2 wt. %, preferably less than 1 wt. %, particularly preferably less than 0.1 wt. % and in particular no enzyme preparation are preferred.

Liquid washing agents which contain, based on the total weight thereof, less than 2 wt. %, preferably less than 1 wt. %, particularly preferably less than 0.1 wt. % and in particular no fragrance are also preferred.

In an alternative embodiment, the liquid washing agent contains at least one optical brightener, preferably a stilbene-type optical brightener. This is contained in the liquid washing agent, based on the total weight thereof, in an amount above 0 wt. %, but preferably in an amount below 1 wt. %, particularly preferably in an amount below 0.6 wt. %. Stilbene-type brighteners for use in the liquid washing agent are preferably selected from the group of triazinyl derivatives of 4,4'-diamino-2,2'-stilbenesulfonic acid. The economically most important stilbene derivatives are DAS1 (disodium 4,4-bis[(4-anilino-6-morpholino-1,3,5-triazin-2-yl)amino]stilbene-2,2-disulfonate) and DSBP (disodium 4,4-bis(2-sulfostyryl)biphenyl).

Alternatively or additionally, the liquid, surfactant-containing washing agent can comprise at least one blue or violet dye. This is contained in the liquid washing agent, based on the total weight thereof, in an amount above 0 wt. %, but preferably in an amount below 0.1 wt. %, particularly preferably below 0.02 wt. %, for example between 0.001 and 0.01 wt. %. A dye of this kind is used, for example, for the purpose of masking a possible yellowish hue in the preparation.

In a preferred method variant, the liquid, surfactant-containing washing agent is enclosed in a water-soluble film after step c) so as to form a washing agent portion unit.

It is preferable to shape the water-soluble film in a deep-drawing apparatus and to combine it with the liquid washing agent to form a washing agent portion unit.

The water-soluble film in which the liquid washing agent is packaged can comprise one or more structurally different water-soluble polymer(s). Particularly suitable water-soluble polymer(s) include polymers from the group of (optionally acetalized) polyvinyl alcohols (PVAL) and the copolymers thereof.

Water-soluble films for producing the water-soluble wrapping are preferably based on a polyvinyl alcohol or a polyvinyl alcohol copolymer of which the molecular weight is in the range of from 10,000 to 1,000,000 $gmol^{-1}$, preferably from 20,000 to 500,000 $gmol^{-1}$, particularly preferably from 30,000 to 100,000 $gmol^{-1}$, and in particular from 40,000 to 80,000 $gmol^{-1}$.

The production of polyvinyl alcohol and polyvinyl alcohol copolymers generally includes the hydrolysis of intermediate polyvinyl acetate. Preferred polyvinyl alcohols and polyvinyl alcohols have a degree of hydrolysis of 70 to 100 mol. %, preferably 80 to 90 mol. %, particularly preferably 81 to 89 mol. %, and in particular 82 to 88 mol. %.

Polyvinyl alcohol copolymers which include, in addition to vinyl alcohol, an ethylenically unsaturated carboxylic acid, or the salt or ester thereof, are preferred. Polyvinyl alcohol copolymers of this kind particularly preferably contain, in addition to vinyl alcohol, sulfonic acids such as 2-acrylamido-2-methyl-1-propane sulfonic acid (AMPS), acrylic acid, methacrylic acid, acrylic acid ester, methacrylic acid ester or mixtures thereof; of the esters, $C_{1-4}$ alkyl esters or $C_{1-4}$ hydroxyalkyl esters are preferred. Other suitable monomers are ethylenically unsaturated dicarboxylic acids, for example itaconic acid, maleic acid, fumaric acid and mixtures thereof.

Suitable water-soluble films are sold, for example, by MonoSol LLC under the names M8630, M8720, M8310, C8400 or M8900. Other suitable films include films named Solublon® PT, Solublon® GA, Solublon® KC or Solublon® KL from Aicello Chemical Europe GmbH or the films VF-HP from Kuraray.

The water-soluble films can contain additional active ingredients or fillers, but also plasticizers and/or solvents, in particular water, as further ingredients.

The group of further active ingredients includes, for example, materials which protect the ingredients of the preparation (A) enclosed by the film material from decomposition or deactivation by light irradiation. Antioxidants, UV absorbers and fluorescent dyes have proven to be particularly suitable for this.

Glycerol, ethylene glycol, diethylene glycol, propanediol, 2-methyl-1,3-propanediol, sorbitol or mixtures thereof, for example, can be used as plasticizers.

To reduce its coefficient of friction, the surface of the water-soluble film can optionally be powder-coated with fine powder. Sodium aluminosilicate, silica, talc and amylose are examples of suitable powdering agents.

It is particularly preferable for the liquid, surfactant-containing washing agent to be enclosed in a water-soluble film after step c) so as to form a washing agent portion unit having a plurality of receiving chambers.

The plurality of receiving chambers of the washing agent portion unit can be arranged spatially one next to the other or one above the other (stacked). While the method according to the invention can be used, in principle, to produce both designs, the technical advantages of the method according to the invention are particularly noticeable when producing washing agent portion units having receiving chambers arranged one next to the other. On the one hand, the specific rheological properties of the liquid washing agent allow rapid and non-dripping dosing even in the smallest of cavities and, on the other hand, the horizontal arrangement of the receiving chambers increases the visibility of the liquid washing agent.

These technical advantages are particularly evident in methods in which washing agent portion units having receiving chambers which enclose one another at least in part are produced. In preferred embodiments of the method, the washing agent portion unit has at least two receiving chambers which enclose one another at least in part. It is also very particularly preferable for the washing agent portion unit to have at least one further receiving chamber which is filled with a colored washing agent preparation.

An exemplary preferred washing agent portion unit that can be produced by means of the method according to the invention has at least two receiving chambers which are surrounded by a water-soluble film, one receiving chamber being filled with the liquid, surfactant-containing washing agent and the other receiving chamber being filled with a second colored washing agent that differs from the liquid, surfactant-containing washing agent.

A further exemplary preferred washing agent portion unit has at least three receiving chambers which are surrounded by a water-soluble film, one receiving chamber being filled with the liquid, surfactant-containing washing agent and at least two further receiving chambers, separated from one another, being filled with a second and a third colored washing agent that differ from one another and from the liquid, surfactant-containing washing agent.

In an alternative embodiment, the washing agent portion unit has at least four receiving chambers which are surrounded by a water-soluble film, one receiving chamber being filled with the liquid, surfactant-containing washing agent and the other three receiving chambers, separated from one another, being filled with a second, a third and a fourth colored washing agent that differ from one another and from the first liquid, surfactant-containing washing agent.

This application provides the following subjects, inter alia:

1. A method for producing a liquid, surfactant-containing washing agent containing
   i) 20 to 80 wt. % surfactant;
   ii) 2 to 15 wt. % fatty acid;
   iii) 0.3 to 8 wt. % of salt of a divalent cation;
   iv) 8 to 35 wt. % solvent;
   said method comprising the steps of:
   a) providing a first flowable washing agent preparation containing a surfactant, fatty acid and solvent;
   b) introducing the salt of a divalent cation into the washing agent preparation so as to form a salt-containing washing agent preparation;
   c) mixing the salt-containing washing agent preparation.
2. The method according to point 1, wherein the first flowable washing agent preparation is provided discontinuously.

3. The method according to one of the previous points, wherein the first flowable washing agent preparation is continuously introduced from a buffer container into a main line.
4. The method according to one of the preceding points, wherein the salt of a divalent cation is continuously introduced into the main line via a secondary line.
5. The method according to one of the preceding points, wherein the salt of a divalent cation is introduced into the main line, via a secondary line, in the form of an aqueous solution.
6. The method according to one of the preceding points, wherein the salt of a divalent cation is introduced into the main line via a secondary line and the outlet opening of the secondary line is within the operating range of a mixing device which is attached within the main line.
7. The method according to one of the preceding points, wherein an active substance from the group of optionally encapsulated fragrances, enzymes, preservatives and bitterns, preferably from the group of optionally encapsulated fragrances, enzymes and preservatives, is introduced into the main line, via a secondary line, after step b).
8. The method according to one of the preceding points, wherein an active substance from the group of fragrances or enzymes is introduced into the main line, via a secondary line, after step b).
9. The method according to one of the preceding points, comprising the steps of:
   a1) providing a first flowable washing agent preparation containing a surfactant, fatty acid and solvent;
   a2) continuously introducing the first flowable washing agent preparation into a main line;
   b) continuously introducing the salt of a divalent cation into the washing agent preparation into the main line, via a secondary line, so as to form a salt-containing washing agent preparation;
   c) mixing the salt-containing composition;
   d) continuously introducing an active substance from the group of fragrances or enzymes into the salt-containing washing agent preparation located in the main line via a secondary line;
   e) mixing the salt-containing and active substance-containing washing agent preparation, it being preferable to connect a static mixer in the main line downstream of the outlet openings of the secondary line in the flow direction of the washing agent preparation in step b) and/or step d).
10. The method according to one of the preceding points, comprising the steps of:
   a1) providing a first flowable washing agent preparation containing a surfactant, fatty acid and solvent;
   a2) continuously introducing the first flowable washing agent preparation into a main line;
   b1) continuously introducing the salt of a divalent cation into the washing agent preparation into the main line, via a secondary line, so as to form a salt-containing washing agent preparation;
   b2) continuously introducing an active substance from the group of fragrances or enzymes into the main line, via a secondary line, so as to form a salt-containing and active substance-containing washing agent preparation;
   c) mixing the salt-containing and active substance-containing washing agent preparation, it being preferable to connect a static mixer in the main line downstream of the outlet openings of the secondary line in the flow direction of the washing agent preparation in step b1) and/or step b2).
11. The method according to one of the preceding points, wherein the liquid, surfactant-containing washing agent contains, based on the total weight thereof, 30 to 75 wt. %, preferably 40 to 70 wt. %, surfactant.
12. The method according to one of the preceding points, wherein the liquid, surfactant-containing washing agent contains, based on the total weight thereof, 20 to 60 wt. %, preferably 25 to 50 wt. %, anionic surfactant.
13. The method according to one of the preceding points, wherein at least one anionic surfactant, preferably at least one anionic surfactant from the group consisting of $C_{8-18}$ alkylbenzene sulfonates, $C_{8-18}$ olefin sulfonates, $C_{12-18}$ alkanesulfonates, $C_{8-18}$ ester sulfonates, $C_{8-18}$ alkyl sulfates, $C_{8-18}$ alkenyl sulfates, fatty alcohol ether sulfates, in particular at least one anionic surfactant from the group of $C_{8-18}$ alkyl benzene sulfonates, is contained as the surfactant.
14. The method according to one of the preceding points, wherein the liquid, surfactant-containing washing agent contains, based on the total weight thereof, 4 to 12 wt. %, preferably 6 to 10 wt. %, fatty acid.
15. The method according to one of the preceding points, wherein the fatty acid is selected from the group of caprylic acid, capric acid, lauric acid, myristic acid, palmitic acid, stearic acid, oleic acid, linoleic acid and mixtures thereof.
16. The method according to one of the preceding points, wherein the liquid, surfactant-containing washing agent contains, based on the total weight thereof, 0.4 to 6 wt. %, preferably 0.5 to 4 wt. %, of salt of a divalent cation.
17. The method according to one of the preceding points, wherein the salt of a divalent cation is selected from the group of divalent metal cations, in particular of magnesium and calcium salts, preferably from the group of magnesium chloride, magnesium sulfate, calcium chloride and calcium sulfate, in particular from the group of magnesium chloride and calcium chloride.
18. The method according to one of the preceding points, wherein the first flowable washing agent preparation contains, based on the total weight thereof,
   i) 20 to 80 wt. % surfactant including 20 to 50 wt. % anionic surfactant;
   ii) 4 to 12 wt. % fatty acid;
   iii) 0.5 to 4 wt. % of the salt of a divalent metal cation;
   iv) 8 to 35 wt. % solvent.
19. The liquid washing agent preparation according to one of the preceding points, wherein the flowable washing agent preparation contains, based on the total weight thereof, 12 to 32 wt. %, preferably 15 to 30 wt. %, solvent.
20. The method according to one of the preceding points, wherein the liquid, surfactant-containing washing agent contains, based on the total weight thereof, 7 to 20 wt. %, preferably 10 to 18 wt. %, organic solvent.
21. The method according to one of the preceding points, wherein the organic solvent is selected from the group of ethanol, n-propanol, i-propanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether and mixtures thereof, preferably from the group of propanediol, glycerol and mixtures thereof.

22. The method according to one of the preceding points, wherein the liquid, surfactant-containing washing agent contains, based on the total weight thereof, less than 18 wt. %, preferably less than 15 wt. %, water.

23. The method according to one of the preceding points, wherein the liquid, surfactant-containing washing agent also contains, based on the total weight thereof,
   v) 0.5 to 4 wt. %, preferably 0.5 to 3 wt. % and in particular 0.5 to 2 wt. %, of the salt of a monovalent cation.

24. The method according to point 23, wherein the salt of a monovalent cation is selected from the group of the salts of monovalent metal cations, preferably from the group of sodium chloride, potassium chloride, sodium sulfate, sodium carbonate, potassium sulfate, potassium carbonate, sodium hydrogen carbonate, potassium hydrogen carbonate, very preferably from the group of sodium chloride.

25. The method according to one of the preceding points, wherein the first flowable washing agent preparation contains, based on the total weight thereof,
   i) 20 to 80 wt. % surfactant including 20 to 50 wt. % anionic surfactant;
   ii) 4 to 12 wt. % fatty acid;
   iii) 0.5 to 4 wt. % of the salt of a divalent metal cation;
   iv) 8 to 35 wt. % solvent;
   v) 0.5 to 4 wt. % of the salt of a monovalent metal cation.

26. The method according to one of the preceding points, wherein the liquid, surfactant-containing washing agent comprises, based on the total weight thereof, 12 to 30 wt. %, preferably 15 to 25 wt. %, non-ionic surfactant.

27. The method according to one of the preceding points, wherein at least one non-ionic surfactant from the group of alkoxylated primary $C_{8-18}$ alcohols having a degree of alkoxylation of ≥4, particularly preferably the $C_{12-14}$ alcohols having 4 EO or 7 EO, the $C_{9-11}$ alcohols having 7 EO, the $C_{13-15}$ alcohols having 5 EO, 7 EO or 8 EO, the $C_{13-15}$ oxo alcohols having 7 EO, the $C_{12-18}$ alcohols having 5 EO or 7 EO, the $C_{13-15}$ oxo alcohols having 7 EO, in particular the primary $C_{12-18}$ alcohols having a degree of alkoxylation of ≥4, very particularly preferably the primary $C_{12-18}$ alcohols having 7 EO, is contained as the surfactant.

28. The method according to one of the preceding points, wherein the liquid, surfactant-containing washing agent contains anionic surfactant and non-ionic surfactant in a weight ratio of from 3:1 to 1:2, preferably from 2:1 to 1:1.5 and in particular from 1.4:1 to 1:1.

29. The method according to one of the preceding points, wherein the liquid, surfactant-containing washing agent also contains, based on the total weight thereof,
   vi) 0.3 to 5 wt. % of a co-surfactant selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.

30. The method according to one of the preceding points, wherein the liquid, surfactant-containing washing agent contains, based on the total weight thereof,
   i) 32.3 to 80 wt. % surfactant including 20 to 50 wt. % anionic surfactant and 12 to 30 wt. % non-ionic surfactant;
   ii) 4 to 12 wt. % fatty acid;
   iii) 0.5 to 4 wt. % of the salt of a divalent cation;
   iv) 8 to 35 wt. % solvent;
   v) 0.3 to 5 wt. % of a co-surfactant that differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_2$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.

31. The method according to one of the preceding points, wherein the first flowable washing agent preparation does not contain any organic opacifying agents, in particular does not contain any styrene-acrylate copolymer.

32. The method according to one of the preceding points, wherein the liquid, surfactant-containing washing agent contains, based on the total weight thereof, less than 2 wt. %, preferably less than 1 wt. %, particularly preferably less than 0.1 wt. % and in particular no enzyme preparation.

33. The method according to one of the preceding points, wherein the liquid, surfactant-containing washing agent contains, based on the total weight thereof, less than 2 wt. %, preferably less than 1 wt. %, particularly preferably less than 0.1 wt. % and in particular no fragrance.

34. The method according to one of the preceding points, wherein the liquid, surfactant-containing washing agent contains, based on the total weight thereof, an optical brightener, preferably a stilbene-type optical brightener, in amounts below 1 wt. %, preferably in amounts below 0.6 wt. %.

35. The method according to point 34, wherein the optical brightener is selected from the group of triazinyl derivatives of 4,4'-diamino-2,2'-stilbenesulfonic acid, in particular DAS1 (disodium 4,4-bis[(4-anilino-6-morpholino-1,3,5-triazin-2-yl)amino]stilbene-2,2-disulfonate) and DSBP (disodium 4,4-bis[(2-sulfostyryl)biphenyl).

36. The method according to one of the preceding points, wherein the liquid, surfactant-containing washing agent contains, based on the total weight thereof, a blue or violet dye in amounts below 0.1 wt. %, preferably below 0.02 wt. %.

37. The method according to one of the preceding points, wherein the liquid, surfactant-containing washing agent has a viscosity (21° C., Brookfield viscometer type DV-II Pro, spindle no. 2, 20 rpm) above 400 mPas, preferably above 1000 mPas.

38. The method according to one of the preceding points, wherein the liquid, surfactant-containing washing agent has a yield point (TA Instruments rotation rheometer AR 2000, 20° C., cone plate with 40 mm diameter, 2° cone angle) above 0.1 Pa, preferably above 0.3 Pa.

39. The method according to one of the preceding points, wherein the liquid, surfactant-containing washing agent has a turbidity (HACH Turbidimeter 2100Q, 20° C., 10 ml cuvette) above 60 NTU, preferably above 100 NTU and in particular above 400 NTU.

40. The method according to one of the preceding points, wherein the liquid, surfactant-containing washing agent contains lamellar spherulites, preferably having a maximum diameter of from 10 to 100 μm, particularly preferably having a maximum diameter of from 25 to 50 μm.

41. The method according to one of the preceding points, wherein the liquid, surfactant-containing washing agent is enclosed in a water-soluble film after step c) so as to form a washing agent portion unit.

42. The method according to point 41, wherein the washing agent portion unit has at least two receiving chambers which are surrounded by a water-soluble film, one receiving chamber being filled with the liquid, surfactant-containing washing agent and the other receiving chamber being filled with a second colored washing agent that differs from the liquid, surfactant-containing washing agent.

43. The method according to point 41, wherein the washing agent portion unit has at least three receiving chambers which are surrounded by a water-soluble film, one receiving chamber being filled with the liquid, surfactant-containing washing agent and the other two receiving chambers, separated from one another, being filled with a second and a third washing agent that differ from one another and from the liquid, surfactant-containing washing agent.

44. The method according to point 41, wherein the washing agent portion unit has at least four receiving chambers which are surrounded by a water-soluble film, one receiving chamber being filled with the liquid, surfactant-containing washing agent and the other three receiving chambers, separated from one another, being filled with a second, a third and a fourth colored washing agent that differ from one another and from the first liquid, surfactant-containing washing agent.

What is claimed is:

1. A method for producing an opacified liquid, surfactant-containing washing agent containing i) 20 to 80 wt. % surfactant comprising anionic surfactant and non-ionic surfactant in a weight ratio from 1.4:1 to 1:1;

ii) 6 to 10 wt. % fatty acid;

iii) 0.3 to 8 wt. % of salt of a divalent cation;

iv) 8 to 35 wt. % solvent;

said method comprising the steps of:

a) providing a first flowable washing agent preparation containing a surfactant, fatty acid and solvent and having a turbidity below 60 NTU;

b) introducing the salt of a divalent cation into the washing agent preparation containing a surfactant, fatty acid and solvent so as to form a cloudy salt-containing composition having a turbidity above 60 NTU, wherein step b) does not include introducing an enzyme; and c) mixing the salt-containing composition.

2. The method according to claim 1, wherein the first flowable washing agent preparation is continuously introduced from a buffer container into a main line.

3. The method according to claim 2, wherein the salt of a divalent cation is continuously introduced into the main line via a secondary line.

4. The method according to claim 2, wherein the salt of a divalent cation is introduced into the main line, via a secondary line, in the form of an aqueous solution.

5. The method according to claim 2, wherein the salt of a divalent cation is introduced into the main line via a secondary line having an outlet opening located within a mixing zone of a mixing device positioned within the main line.

6. The method according to claim 1, wherein the liquid, surfactant-containing washing agent contains, based on the total weight thereof, 40 to 70 wt. % surfactant.

7. The method according to claim 1, wherein the salt of a divalent cation is selected from the group consisting of magnesium salts and calcium salts.

8. The method according to claim 1, wherein the liquid, surfactant-containing washing agent contains, based on the total weight thereof, i) 20 to 80 wt. % surfactant including 20 to 50 wt. % anionic surfactant and 15 to 25 wt. % non-ionic surfactant;

ii) 6 to 10 wt. % fatty acid;

iii) 0.5 to 4 wt. % of a salt of a divalent metal cation;

iv) 8 to 35 wt. % solvent.

9. The method according to claim 1, wherein the liquid, surfactant-containing washing agent has a yield point above 0.1 Pa when measured using a rotation rheometer at 20° C. with a cone plate with 40 mm diameter and a 2° cone angle.

10. The method according to claim 1, wherein the liquid, surfactant-containing washing agent is enclosed in a water-soluble film after step c) so as to form a washing agent portion unit.

11. The method according to claim 1, wherein 8 to 35 wt. % solvent contains 10 to 18 wt. % organic solvent.

12. The method according to claim 7, wherein the salt of a divalent cation is selected from the group of magnesium chloride, magnesium sulfate, calcium chloride and calcium sulfate.

13. The method according to claim 7, wherein the salt of a divalent cation is selected from the group of magnesium chloride and calcium chloride.

14. The method according to claim 9, wherein the liquid, surfactant-containing washing agent has a yield point above 0.3 Pa.

15. The method according to claim 1, wherein during step b) the washing agent preparation has a temperature of between −20° C. and 40° C.

16. The method according to claim 1, wherein the liquid, surfactant-containing washing agent further contains v) 0.5 to 4 wt. % of a salt of a monovalent cation selected from the group of sodium chloride, potassium chloride, sodium sulfate, sodium carbonate, potassium sulfate, potassium carbonate, sodium hydrogen carbonate, potassium hydrogen carbonate, and combinations thereof.

17. The method according to claim 16, wherein the monovalent cation is sodium chloride.

18. The method according to claim 16, wherein the monovalent cation is 0.5 to 2 wt. %.

19. The method according to claim 1, wherein the washing agent is free of enzymes.

20. The method according to claim 1, wherein the washing agent contains less than 1 wt. % enzymes.

* * * * *